US007923667B2

(12) United States Patent
Isidorovic et al.

(10) Patent No.: US 7,923,667 B2
(45) Date of Patent: Apr. 12, 2011

(54) ELECTRIC ROOM HEATER

(76) Inventors: Ratko Isidorovic, Belgrade (YU); Janko Isidorovic, Belgrade (YU); Ksenija Isidorovic, Belgrade (YU)

( * ) Notice: Subject to any disclaimer, the term of this patent is extended or adjusted under 35 U.S.C. 154(b) by 348 days.

(21) Appl. No.: 12/065,785

(22) PCT Filed: Aug. 18, 2006

(86) PCT No.: PCT/YU2006/000021

§ 371 (c)(1),
(2), (4) Date: Mar. 5, 2008

(87) PCT Pub. No.: WO2007/030838

PCT Pub. Date: Mar. 15, 2007

(65) Prior Publication Data

US 2008/0237218 A1 Oct. 2, 2008

(30) Foreign Application Priority Data

Sep. 6, 2005 (YU) ..... P-2005/0682

(51) Int. Cl.
*H05B 3/06* (2006.01)

(52) U.S. Cl. ..... 219/520; 219/537; 392/373; 392/375

(58) Field of Classification Search ..... 219/520, 219/528, 530, 532, 534, 536, 531, 537, 548, 219/550; 392/365, 367, 368, 372, 376, 420, 392/422, 439, 485, 347, 351, 354, 355, 373, 392/374, 375

See application file for complete search history.

(56) References Cited

U.S. PATENT DOCUMENTS

| | | | | | |
|---|---|---|---|---|---|
| 1,669,588 | A | * | 5/1928 | Burns et al. | 392/355 |
| 2,250,691 | A | * | 7/1941 | Wilson et al. | 392/375 |
| 2,268,233 | A | * | 12/1941 | Wilson et al. | 392/373 |
| 2,583,754 | A | * | 1/1952 | Theisen | 392/376 |
| 2,697,164 | A | * | 12/1954 | Knapp et al. | 392/368 |
| 2,712,053 | A | * | 6/1955 | Gallay | 392/367 |
| 2,873,071 | A | * | 2/1959 | Bratton | 237/2 R |
| 2,875,316 | A | * | 2/1959 | Ford et al. | 219/473 |
| 3,086,187 | A | | 4/1963 | Duggan et al. | |
| 3,091,324 | A | * | 5/1963 | Brown et al. | 198/352 |
| 4,551,614 | A | * | 11/1985 | Johnson | 392/433 |
| 4,994,654 | A | * | 2/1991 | St. Louis | 219/532 |
| 5,497,394 | A | * | 3/1996 | Jhawar et al. | 373/130 |
| 5,641,420 | A | * | 6/1997 | Peterson et al. | 219/536 |
| 5,644,974 | A | * | 7/1997 | Slavin | 99/328 |
| 5,655,055 | A | * | 8/1997 | Goldstein et al. | 392/367 |
| 6,003,242 | A | * | 12/1999 | Carley et al. | 34/202 |
| 7,639,928 | B2 | * | 12/2009 | Coke | 392/367 |
| 2006/0018640 | A1 | * | 1/2006 | Hinesley | 392/420 |

FOREIGN PATENT DOCUMENTS

| | | | |
|---|---|---|---|
| DE | 19846402 | A1 * | 4/2000 |
| EP | 523373 | A1 * | 1/1993 |

(Continued)

*Primary Examiner* — Geoffrey S Evans
*Assistant Examiner* — Vinod D Patel
(74) *Attorney, Agent, or Firm* — Brooks Kushman P.C.

(57) ABSTRACT

Electric Room Heater in its housing contains heaters which consist of strip of oriented cold rolled transformer sheet that are cooled by natural air circulation. Heater consists of two cross supports (11) connected by a central support (14). Between the cross supports are placed non-flammable insulating holders (13). The insulating holders have sprockets. Between sprockets lies strip of the heater of oriented cold rolled transformer sheet (12). The insulating holder (13) by its width (17) creates distance between layers of heater strips, and by sprockets width (18) makes distance between adjacent strips, windings, in the layer. These distances make channels for air circulation, thus enabling strip temperature to be less then 100° C.

5 Claims, 3 Drawing Sheets

FOREIGN PATENT DOCUMENTS

| | | | | |
|---|---|---|---|---|
| GB | 140868 | | | 4/1920 |
| GB | 1000714 | | | 8/1965 |
| RU | 2163422 | C1 | * | 2/2001 |
| WO | WO-03/017721 | A2 | * | 2/2003 |

* cited by examiner

ELECTRIC ROOM HEATER

TECHNICAL FIELD

The invention belongs to the field of transformation of electrical energy into thermal energy. The invention is intended to be used to heat rooms, and indoor areas.

The invention deals with the problem of room heating by electrical heater with surface temperature which cannot provoke fire. Due to the lower surface temperature of the heater, it permanently maintains its thermal and mechanical properties. The Electric Room Heater is cooled by natural air circulation.

BACKGROUND ART

When electrical energy is used for room heating it is usually performed by electric heaters with red hot fibre. Red hot fibre has high working temperature. There are several methods of cooling it and preventing it from provoking fire. In order to decrease temperature of the heater, fans are used or the heaters are immersed in thermal oil or similar. The red hot fibre has limited duration time because of its high working temperature.

DISCLOSURE OF THE INVENTION

Electric Room Heater has a heater made from a heating element which is in a form of a strip. The heating element is wound on the insulating holders. Cross-section of the strip is in a form of a narrow and long rectangle. Therefore, cooling surface of the heater is bigger than for a heater which has a circular cross-section with the same cross-section surface. This provides larger surface for cooling and the larger cooling surface enables the heater to work at lower working temperature. Contacts of insulation holders with the heating element are covering a small surface of the heating element.

Material used for production of the heating element is oriented cold rolled transformer sheet which has electrical resistance that enables lower temperature of transformation of electrical energy into thermal energy. This makes natural air circulation sufficient to cool the heater and to avoid possibility of provoking fire. Maximum temperature of the heater is up to 100° C. Lower temperature does not affect internal structure, mechanical, electrical and thermal properties of the heater and allows the heater to be used for a long time without a failure.

The heater is placed in housing for protection against contacts but required air circulation is provided.

BEST MODE FOR CARRYING OUT OF THE INVENTION

Figure 1:
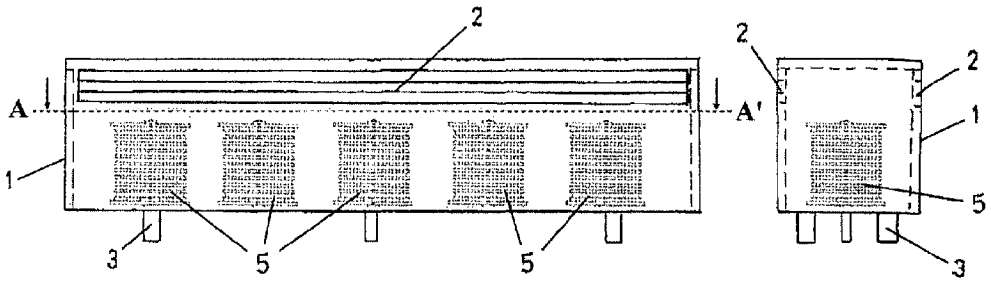
FIG. 1 shows two projections of the housing and placement of the heaters therein.
Figure 2:
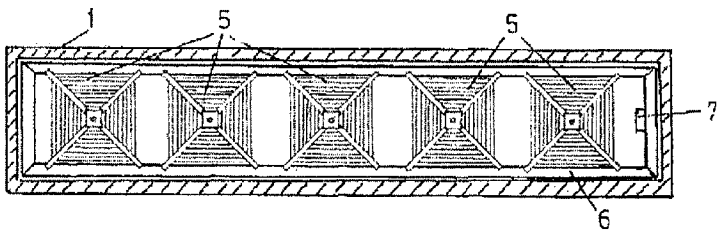
FIG. 2 represents cross-section of the housing to show heaters.
Figure 3:
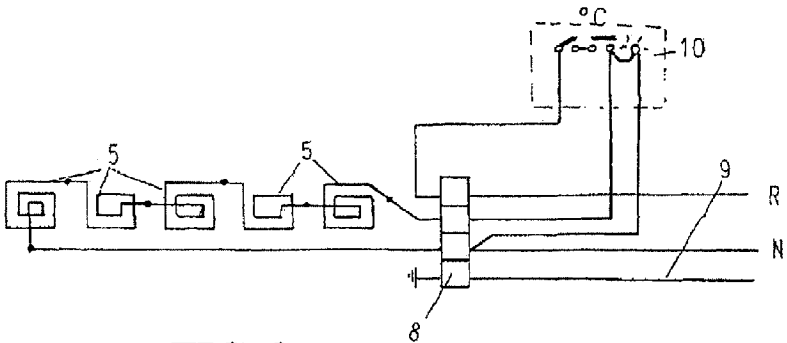
FIG. 3 shows the scheme of electric connection.

Electric Room Heater, FIG. 1, includes: housing 1, blinds for air circulation 2, and supports legs 3 that also function as spacers between floor and heaters 5. Housing 1 is cut by AA'-axis, FIG. 2, to provide view on heaters 5. The heaters 5 are fixed to a supporting frame 6. There is the supporting frame 6 on the upper side of the heaters 5 also, and it is used for holding the heaters 5 in place. Housing 1 is also fixed to the supporting frame 6. Electric connection of heaters 5 is serial, FIG. 3. Clamp 8 is fixed to holder 7, FIG. 2. The clamp is used to make electrical connections between: heaters 5, connecting cable 9, and thermostat, signal lamp, and switch, collectively 10.

Figure 4:
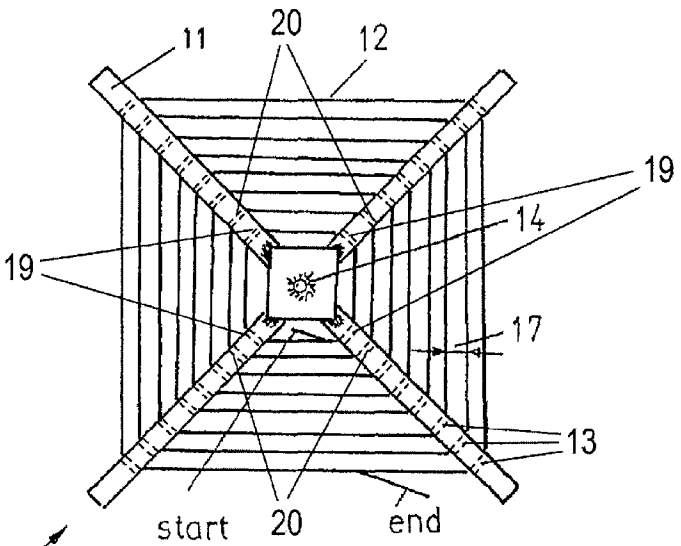
FIG. 4 shows view of the heater from above and placement of the insulating holders.
Figure 5:
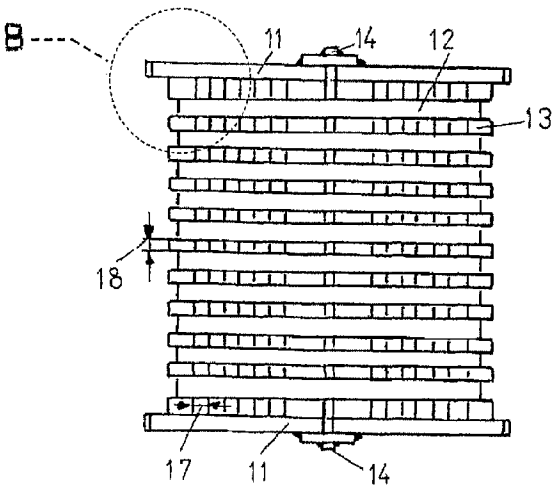
FIG. 5 shows view of the heater from the side.
Figure 6:
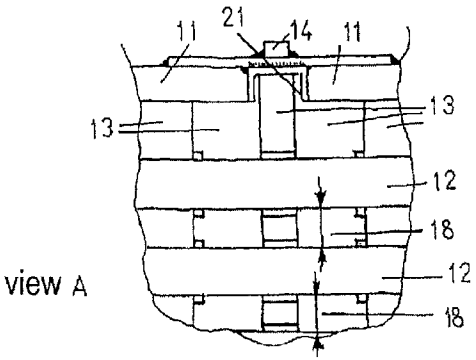
FIG. 6 represents view A to show detail of connecting insulating holder within the U profile of the cross support.
Figure 7:
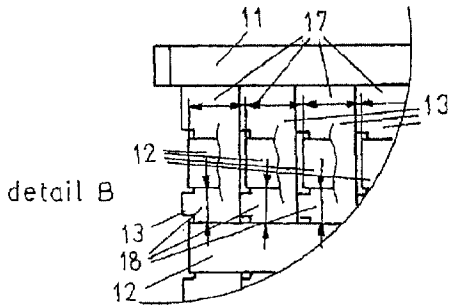
FIG. 7 represents detail B to present leaning of heating element against insulating holder.
Figure 8:
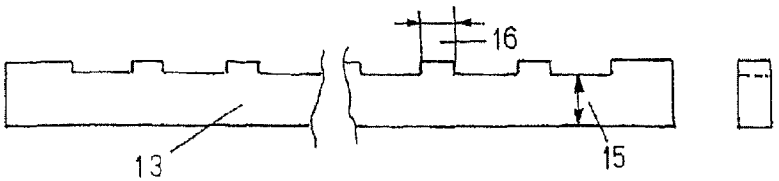
FIG. 8 shows insulating holder with teeth.

Each heater 5, FIG. 4 and FIG. 5, includes two opposing cross supports 11 connected by a central support 14. Between the opposing cross supports 11, which are in a form of U profile 21, FIG. 6, are placed nonflammable insulating holders 13, FIG. 6. Insulating holders 13, FIG. 8, have teeth. Between the teeth is wound heating element 12, made of oriented cold rolled transformer sheet, FIG. 6 and FIG. 7. The insulating holders 13 are grouped into a plurality of insulating holder sets. The insulating holder sets define a first insulating holder set 19 adjacent to the central axis and a second insulating holder set 20 radially outward from and adjacent to the insulating holders 13 of the first insulating holder set 19. Insulating holder 13 by its radial dimension 15 makes radial clearance 17 between the generally concentric rings of heating element, and by vertical dimension 16 of the teeth creates vertical clearance 18 between the vertically stacked layers of heating element 12. These clearances 17, 18 make electric insulation between the concentric rings and stacked layers. In compliance with the idea of the invention these clearances 17, 18 create channels for air circulation thus enabling air to take thermal energy from the heating element 12. Air, on one side, cools the heating element 12 and on another side heats the room in which the Electric Room Heater is situated. Also, in harmony with idea of the invention, temperature of the heating element 12 does not exceed 100° C. and cannot provoke fire, not even in case when inflammable material, for instance—paper, happens to be in direct contact with the heating element 12. Reduced temperature of the heater 5 does not interfere with the internal structure, thermal, mechanical and electrical properties and the heater 5 cannot brake down because of extended use of the Electric Room Heater.

The invention claimed is:

1. A floor-mounted electric room heater, the electric room heater comprising:

a housing defining an enclosed space, the housing having a plurality of blinds extending along the housing for permitting heated air to exit the housing;

a plurality of heaters connected in series, each of the heaters having a generally vertical central axis, being located within the housing in spaced apart relation, each including:

a plurality of concentric insulating holder sets, each of the sets having a plurality of insulating holders radially spaced from the central axis, each of the insulating holders having a radial dimension and a plurality of vertically spaced apart teeth extending radially outward, each of the teeth having a vertical dimension, the plurality of concentric insulating holder sets defining a first insulating holder set adjacent to the central axis and a second insulating holder set radially outward from, spaced apart and adjacent to the insulating holders of the first insulating holder set; and a heating element formed of cold rolled sheet and having a rectangular cross-section, the heating element being helically and successively wound between the teeth of the first insulating holder set and then the teeth of the second insulating holder set to form a plurality of generally concentric rings and vertically stacked layers of heating element, wherein the radial dimension and the vertical dimension maintain radial and vertical clearances between the generally concentric rings and vertically stacked layers;

a supporting frame rigidly securing the housing and the heaters; and a plurality of support legs extending from the support frame to provide spacing between the heaters and the floor.

2. The electric room heater of claim 1, wherein each of the heaters further includes two opposing cross supports and a central support, each of the cross supports having a U profile extending radially from the central support for securing the ends of the insulating holders.

3. The electric room heater of claim 2, wherein the central support extends along the central axis and through the heater for fixing both the position of the heater and the position of the cross supports to the supporting frame.

4. The electric room heater of claim 1, wherein there are 8 concentric insulating holder sets.

5. The electric room heater of claim 1, further comprising a thermostat, a signal lamp, and a switch, the switch connected in series with the heating element to control electrical current flow, the thermostat connected in series with the switch and the heating element to ensure the temperature of the heating element is less than 100 degrees Celsius, the signal lamp connected in parallel with the heating element to indicate when electrical current is flowing through the heating element.

* * * * *